United States Patent [19]

Giberson et al.

[11] Patent Number: 4,658,602

[45] Date of Patent: Apr. 21, 1987

[54] REFRIGERATION EVAPORATORS WITH PITCHED TOP PANEL

[75] Inventors: Wayne F. Giberson, Yardville; Glenn T. Estep, Trenton, both of N.J.; Daniel E. Kramer, Yardley, Pa.

[73] Assignee: Kramer Trenton Co., Trenton, N.J. ; by said Giberson and Estep

[21] Appl. No.: 812,891

[22] Filed: Dec. 23, 1985

[51] Int. Cl.[4] ..... F25B 39/02

[52] U.S. Cl. ..... 62/515; 62/285; 62/291; 62/523; 62/DIG. 16

[58] Field of Search ..... 62/DIG. 16, 285, 286, 62/291, 259.1, 263, 448, 449, 515, 516, 523; 98/31; 165/48

[56] References Cited

U.S. PATENT DOCUMENTS

| | | | |
|---|---|---|---|
| 1,991,762 | 2/1935 | Leyner | 62/523 |
| 2,118,637 | 5/1938 | Atchison | 62/523 X |
| 2,384,313 | 9/1945 | Kohler | 62/285 |
| 2,886,956 | 5/1959 | Loveley | 62/285 |
| 3,318,107 | 5/1967 | Riley et al. | 62/285 X |
| 3,524,328 | 8/1970 | Schuster | 62/285 |
| 3,596,475 | 8/1971 | Berger | 62/291 X |
| 4,086,782 | 5/1978 | Forsberg | 62/515 X |
| 4,369,148 | 1/1983 | Hawkins | 62/DIG. 16 |
| 4,597,269 | 7/1986 | Kim | 62/286 |

*Primary Examiner*—Lloyd L. King

*Attorney, Agent, or Firm*—Daniel E. Kramer

[57] ABSTRACT

The means and method of pitching a refrigeration evaporator toward its drain outlet which includes a top plate of variable thickness. The evaporator is secured to the top plate. When the top plate is secured against the horizontal ceiling, the evaporator is caused to pitch, so that condensate leaving the coil and entering the drain pan flows directly to the drain fitting which is positioned under the portion of the top plate having the greatest thickness.

5 Claims, 5 Drawing Figures

REFRIGERATION EVAPORATORS WITH PITCHED TOP PANEL

BACKGROUND OF THE INVENTION

1. Field of the Invention

This invention is directed toward apparatuses, and, in particular, refrigeration evaporators and means for pitching their drain pans to ensure condensate drainage.

2. Description of the Prior Art

The only prior art known to the inventor is represented by FIG. 1, where the pitch of the evaporator is established by hangers having different heights.

SUMMARY OF THE INVENTION

A device, such as a refrigeration evaporator, which must be pitched to ensure water or condensate drainage from one end and must simultaneously be installable in such a way that there is no gap between itself and the ceiling mounting surface, is produced with a top plate whose thickness varies from maximum to minimum, the maximum thickness being positioned substantially over the position of the drain pan outlet, and the minimum thickness being positioned at an opposite position in the top plate.

DESCRIPTION OF THE PREFERRED EMBODIMENTS

Figure 1:
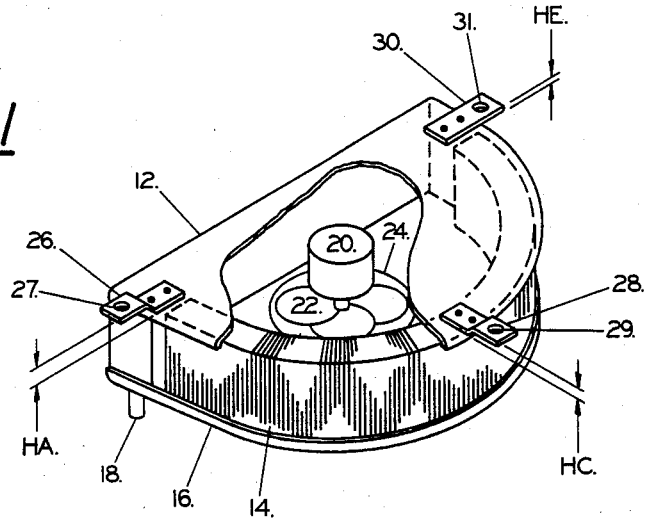
FIGURE 1 (PRIOR ART)
FIG. 1 is a representation of a curved evaporator, well known in the prior art, having hangers of different heights.

FIG. 1, representing the prior art, shows curvilinear coil 14 which is traversed by refrigerant carrying tubes, not shown, covered by a top plate 12, with hangers 26, 28 and 30, for attaching the unit to the ceiling and pitching it. Hanger 26 over the drain fitting 18 has a relatively great elevation HA. Hanger 28 has a relatively lesser elevation HC. Hanger 30, furthest from the drain, has a minimum elevation HE. The hangers have holes for mounting 27, 29 and 31 respectively. Through the cutaway portion, motor 20 and fan 22 can be observed. These are provided for the purpose of blowing room air into the evaporator through fan hole 24 and through cooling coil 14 in a radial direction. Underneath coil 14 is drain pan 16 which is normally secured to coil 14 and spaced substantially uniformly from it. Drain outlet 18 is positioned substantially under the position of the hanger 26 having the greatest height HA, since this position represents, and the drain outlet 18 should be located at, the point in drain pan 16 which is lowest and toward which all condensate will flow.

Figure 2:
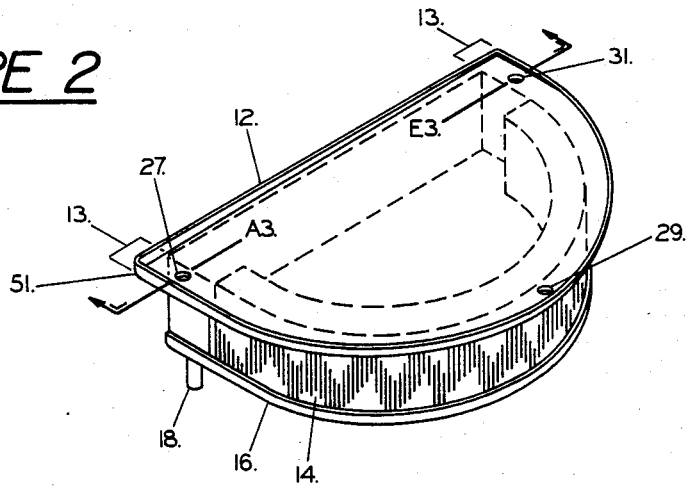
FIG. 2 is a representation of the invention showing the top plate overhanging the evaporator.

FIG. 2 shows the same coil 14, drain pan 16 and drain outlet 18 as in FIG. 1. The top plate 12 of the invention is shown having a variable thickness. The variable thickness is achieved by forming in the sheet an upraised edge 51 whose height is a variable, being greatest at a position substantially over drain fitting 18 and being least at a position substantially far from drain fitting 18. Mounting holes 27, 29 and 31 are shown in substantially the same positions relative to coil 14 as they occupy in FIG. 1.

Fan motor 20, fan 22 and fan hole 24, though present, are not shown.

Figure 3:
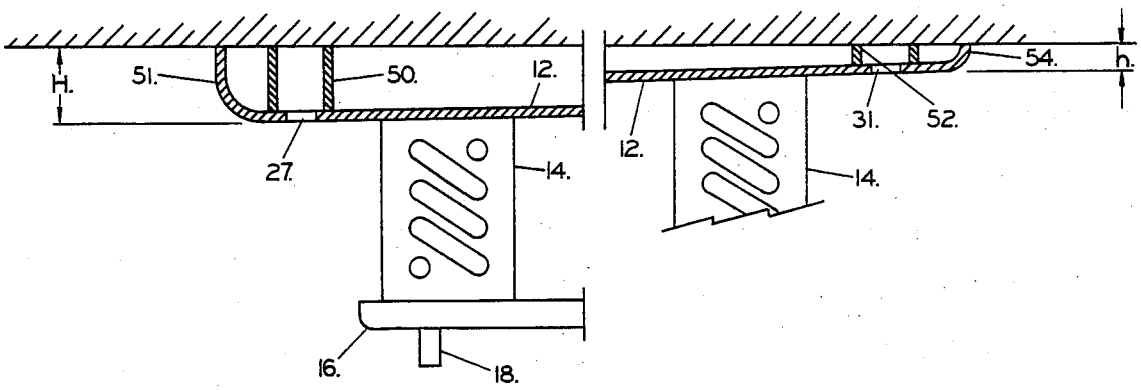
FIG. 3 is a cross-section of the top plate and coil of FIG. 2 at various positions showing a thick and a thin portion of the evaporator top plate.

FIG. 3 shows a detail in cross-section of the top plate and coil of FIG. 2. In the lefthand portion, rolled-up edge 51, having greatest height H, is positioned substantially over the location of drain outlet 18, while rolled edge 54, having the lowest height h, is positioned at a substantially opposite, or distant, position in the top plate, allowing the fin coil 14, and therefore the drain pan uniformly spaced from it to have a pitch sufficient to ensure condensate drainage toward drain outlet 18, while at the same time providing no gap between the evaporator and the ceiling which would allow the accumulation of unsanitary dust, dirt, organic material or debris, which might be hard to clean or remove.

Figure 4:
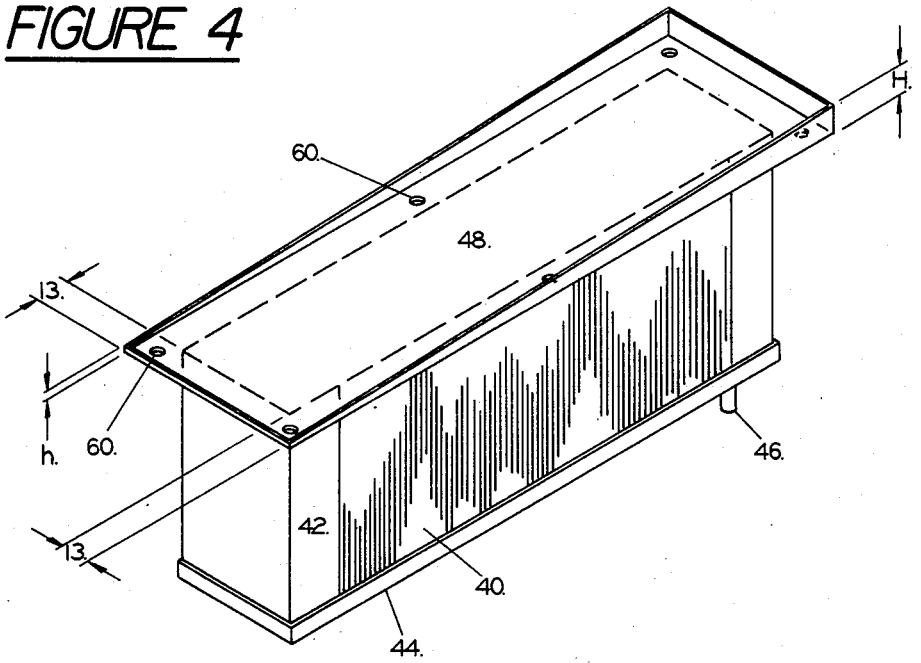
FIG. 4 is a representation of a top plate having variable thickness applied to a rectilinear rather than a curvilinear evaporator.

FIG. 4 is a representation of a rectangular evaporator having coil 40, drain pan 44, and drain outlet 46, and top plate of variable thickness 48, haivng portions 13 overhanging the sides of the evaporator in which mounting holes 60 are positioned, whereby the evaporator can be mounted securely against the ceiling providing satisfactory pitch for drainage or condensate to a drain outlet 46, while at the same time leaving no gap or crevice between itself and the ceiling which would allow accumulation of dirt.

Figure 5:
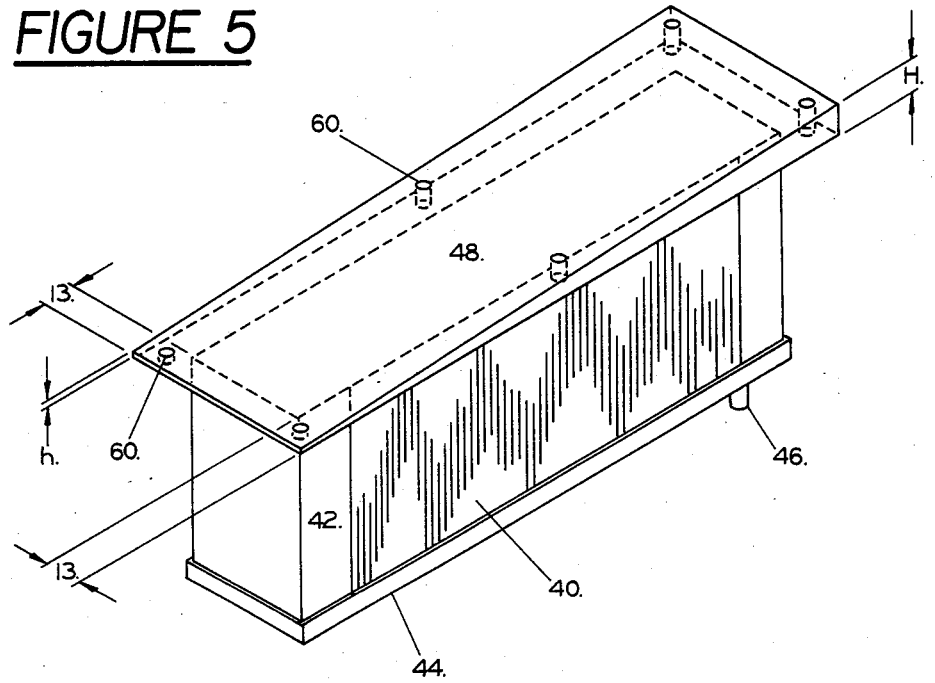
FIG. 5 is an evaporator where the variable thickness top plate is solid.

FIG. 5 is like FIG. 4 except that the variable thickness top plate is solid.

We claim:

1. A refrigeration evaporator including a fin pack, means postioned above the fin pack for variably spacing the fin pack from a substantially horizontal mounting surface, said means comprising a top plate of varying thickness.

2. An evaporator as in claim 1 where the spacing means comprises a thin sheetlike member including upturned edges having varying heights.

3. An evaporator as in claim 1 where a portion of the spacing means overhangs the evaporator.

4. An evaporator as in claim 3 including mounting means where the mounting means and the spacing means are integral.

5. An evaporator as in claim 4 where the mounting means are in the overhanging portion of the spacing means.

* * * * *